US007987908B2

(12) United States Patent
Colley, III

(10) Patent No.: US 7,987,908 B2
(45) Date of Patent: Aug. 2, 2011

(54) WELL TREATMENT USING A PROGRESSIVE CAVITY PUMP

(75) Inventor: E. Lee Colley, III, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 395 days.

(21) Appl. No.: 11/912,283

(22) PCT Filed: Apr. 25, 2006

(86) PCT No.: PCT/US2006/015384

§ 371 (c)(1),
(2), (4) Date: Jun. 25, 2008

(87) PCT Pub. No.: WO2006/116255

PCT Pub. Date: Nov. 2, 2006

(65) Prior Publication Data

US 2009/0223665 A1 Sep. 10, 2009

Related U.S. Application Data

(60) Provisional application No. 60/674,805, filed on Apr. 25, 2005.

(51) Int. Cl.
*E21B 43/00* (2006.01)

(52) U.S. Cl. ..... 166/263; 166/308.1; 166/372; 166/68; 166/105

(58) Field of Classification Search ..... 166/259, 166/260, 263, 308.1, 372, 305.1, 280.1, 68, 166/105; 417/410.3, 410.4, 199.1, 904; 415/901; 418/48

See application file for complete search history.

(56) References Cited

U.S. PATENT DOCUMENTS

| | | | | |
|---|---|---|---|---|
| 1,892,217 | A | 12/1932 | Moineau | |
| 2,693,854 | A * | 11/1954 | Abendroth | 166/278 |
| 5,295,393 | A * | 3/1994 | Thiercelin | 73/152.51 |
| 5,697,678 | A | 12/1997 | Mills | |
| 6,079,491 | A * | 6/2000 | Stuebinger et al. | 166/266 |
| 6,358,027 | B1 | 3/2002 | Lane | |

(Continued)

FOREIGN PATENT DOCUMENTS

WO WO 03/036016 5/2003

(Continued)

OTHER PUBLICATIONS

GB Examination Report for GB0720858.0 dated Mar. 2, 2010.

(Continued)

*Primary Examiner* — Kenneth Thompson
*Assistant Examiner* — Cathleen R Hutchins
(74) *Attorney, Agent, or Firm* — Patterson & Sheridan, LLP

(57) ABSTRACT

Embodiments of the present invention include methods and apparatus for treating a formation with fluid using a downhole progressive cavity pump ("PCP"). In one aspect, the direction of the PCP is reversible to pump treatment fluid into the formation. In another aspect, two or more PCP's are disposed downhole and reversible to allow a chemical reaction downhole prior to the treatment fluid entering the formation. In yet another aspect, embodiments of the present invention provide a method of flowing treatment fluid downhole using one or more downhole PCP's. Treatment of the formation with the fluid and production of hydrocarbon fluid from the formation may both be conducted using the same downhole PCP operating in opposite rotational directions. In an alternate embodiment, one or more downhole PCP's may be utilized in tandem with one or more surface pumps.

52 Claims, 5 Drawing Sheets

U.S. PATENT DOCUMENTS

| | | | |
|---|---|---|---|
| 6,439,310 | B1 | 8/2002 | Scott, III et al. |
| 7,337,851 | B2 | 3/2008 | Hall et al. |
| 2003/0146001 | A1 | 8/2003 | Hosie et al. |
| 2005/0047944 | A1 | 3/2005 | Howard |

FOREIGN PATENT DOCUMENTS

| | | |
|---|---|---|
| WO | WO 03/042496 | 5/2003 |

OTHER PUBLICATIONS

International Search Report for International Patent Application No. PCT/US2006/015384 dated Aug. 9, 2006.

Canadian Office Action for Application No. 2,605,914 dated Jul. 15, 2010.

Weatherford "Progressing Cavity Pumps" brochure, 1998.

* cited by examiner

WELL TREATMENT USING A PROGRESSIVE CAVITY PUMP

CROSS REFERENCE TO RELATED APPLICATION

This application claims benefit of co-pending U.S. Provisional Patent Application Ser. No. 60/674,805, filed on Apr. 25, 2005, which application is herein incorporated by reference in its entirety.

BACKGROUND OF THE INVENTION

1. Field of the Invention

Embodiments of the present invention generally relate to artificial fluid-lift mechanisms within a wellbore. More particularly, embodiments of the present invention relate to progressive cavity pumps within the wellbore.

2. Description of the Related Art

To obtain hydrocarbon fluids from an earth formation, a wellbore is drilled into the earth to intersect an area of interest within a formation. The wellbore may then be "completed" by inserting casing within the wellbore and setting the casing therein using cement. In the alternative, the wellbore may remain uncased (an "open hole wellbore"), or may become only partially cased. Regardless of the form of the wellbore, production tubing is typically run into the wellbore (within the casing when the well is at least partially cased) primarily to convey production fluid (e.g., hydrocarbon fluid, which may also include water) from the area of interest within the wellbore to the surface of the wellbore.

Often, pressure within the wellbore is insufficient to cause the production fluid to naturally rise through the production tubing to the surface of the wellbore. Thus, to carry the production fluid from the area of interest within the wellbore to the surface of the wellbore, artificial lift means is sometimes necessary. Some artificially-lifted wells are equipped with sucker rod lifting systems. Sucker rod lifting systems generally include a surface drive mechanism, a sucker rod string, and a downhole positive displacement pump. Fluid is brought to the surface of the wellbore by pumping action of the downhole pump, as dictated by the drive mechanism attached to the rod string.

One type of sucker rod lifting system is a rotary positive displacement pump, typically termed a progressive cavity pump ("PCP"). These pumps typically use an offset helix screw configuration, where the threads of the screw or "rotor" portion are not equal to those of the stationary, or "stator" portion over the length of the pump. By insertion of the rotor portion into the stator portion of the pump, a plurality of helical cavities is created within the pump that, as the rotor is rotated with respect to the pump housing, cause a positive displacement of the fluid through the pump. To enable this pumping action, the surface of the rotor must be sealingly engaged to that of the stator, which also typically is an integral part of the housing. This sealing provides the plurality of cavities between the rotor and stator, which "progress" up the length of the pump when the rotor rotates with respect to the housing. The sealing is typically accomplished by providing at least the inner bore or stator surface of the housing with a compliant material such as nitrile rubber. The outermost radial extension of the rotor pushes against this rubber material as it rotates, thereby sealing each cavity formed between the rotor and the housing to enable positive displacement of fluid through the pump when rotation occurs relative to the rotor-housing couple.

Rotation of the rotor relative to the housing is accomplished by extending the sucker rod string, which is rotatably driven by a motor at the surface, down the borehole to connect to one end of the rotor exterior of the housing. At the lower end of the pump, an inlet is formed for allowing production fluid to flow into the production tubing, and at the upper end of the pump, production tubing extends from the pump outlet to a receiving means on the surface, such as a tank, reservoir, or pipeline.

Often before, during, or after the course of producing hydrocarbon fluid from the area of interest, one or more fluid treatments must be performed to remedy production problems. Effecting fluid treatments involves forcing treatment fluid into the formation, possibly into the area of interest in the formation. The fluid treatment may involve, for example, fracturing the formation using a fracturing fluid to allow improved draining of the reservoir within the area of interest or introducing inhibitors or functional additives into the formation to prevent paraffin, scale, corrosion, or excess water production.

To perform fluid treatment on the formation, pumps are required to overcome bottomhole pressure within the wellbore and force the treatment fluid into the formation. Currently, the pumps utilized to effect treatments are truck-mounted pumping units, usually cement pump trucks, which must be mobilized to the well site when fluid treatment is necessary and connected to the production tubing to pump fluid downhole within the production tubing and into the formation.

Using the truck-mounted pumping units to treat the formation is expensive, as the equipment is costly to rent for each day in which its use is desired. The truck-mounted pumping units may cost more than a million dollars each, so that significant fees are charged to rent the pumping units. Treatment of the formation with the truck-mounted pumping units is especially costly when fluid treatment operations are necessary which are most effective when utilizing low flow rates of treatment fluid to pump large volumes of treatment fluid over long periods of time.

An additional cost of treating the wellbore using truck-mounted pumping units lies in the hazardous nature of some of the chemicals employed for well treatments. These hazardous chemicals may inadvertently contact operators of the truck-mounted pumping units, creating a safety issue as well as increasing the cost of the well treatment due to additional safety costs.

Furthermore, additional cost is incurred using the truck-mounted pumping units to treat the formation because in order to operate the pumping units, the PCP must be pulled out of the wellbore (and then re-inserted into the wellbore after the treatment). Removing the PCP from the wellbore and again placing the PCP within the wellbore add to the well treatment price tag the cost of operation of a workover rig, which may require rental fees of $500 or more per hour of use.

Due to the sometimes prohibitive cost of treatment of the formation using the truck-mounting pumping unit, the duration of each fluid treatment is frequently cut short, such that maximum production during a period of time between treatments is not attained because the well is never effectively treated. Moreover, because wellbore treatment sometimes becomes too expensive using the truck-mounted pumping units and because the returns expected from the wellbore are not sufficiently high to justify treatment of the formation by the treatment fluid, the well may be shut down without realization of the full potential of the well production. At the very least, the high cost of treatment when using the truck-mounted pumping units decreases the profitability of the well.

Another problem with the use of truck-mounted pumping units at the surface of the wellbore is that chemicals used in treating the formation must be created from their constituents at the surface of the wellbore for pumping downhole. Some chemicals are time-sensitive and are more effective early upon their creation from the constituents; therefore, these time-sensitive chemicals may be rendered ineffective or less effective after the chemicals have traveled from the surface of the wellbore all the way downhole into the area of interest.

There is therefore a need for more cost-effective apparatus and methods for pumping treatment fluid into a formation. Further, there is a need for more cost-effective apparatus and methods for pumping treatment fluid into a formation which has been equipped with production equipment. There is an additional need for apparatus and methods for maximizing the effectiveness of time-sensitive chemicals utilized to treat the formation.

SUMMARY OF THE INVENTION

In one aspect, embodiments of the present invention generally provide a method of pumping fluid into a wellbore within an earth formation, comprising providing a first progressive cavity pump within a tubular body, the tubular body disposed downhole within the wellbore; and operating the first progressive cavity pump to pump a first fluid downhole through the tubular body into the wellbore. In another aspect, embodiments of the present invention provide an apparatus for treating a location within an earth formation surrounding a wellbore, comprising a reversible progressive cavity pump disposed within a tubular body, the progressive cavity pump comprising a rotor disposed within a stator, the rotor capable of rotating relative to the stator in a first direction and a second direction, wherein rotation of the rotor in the first direction is capable of pumping fluid in one direction within the tubular body and the rotation of the rotor in the second direction is capable of pumping fluid in an opposite direction within the tubular body.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
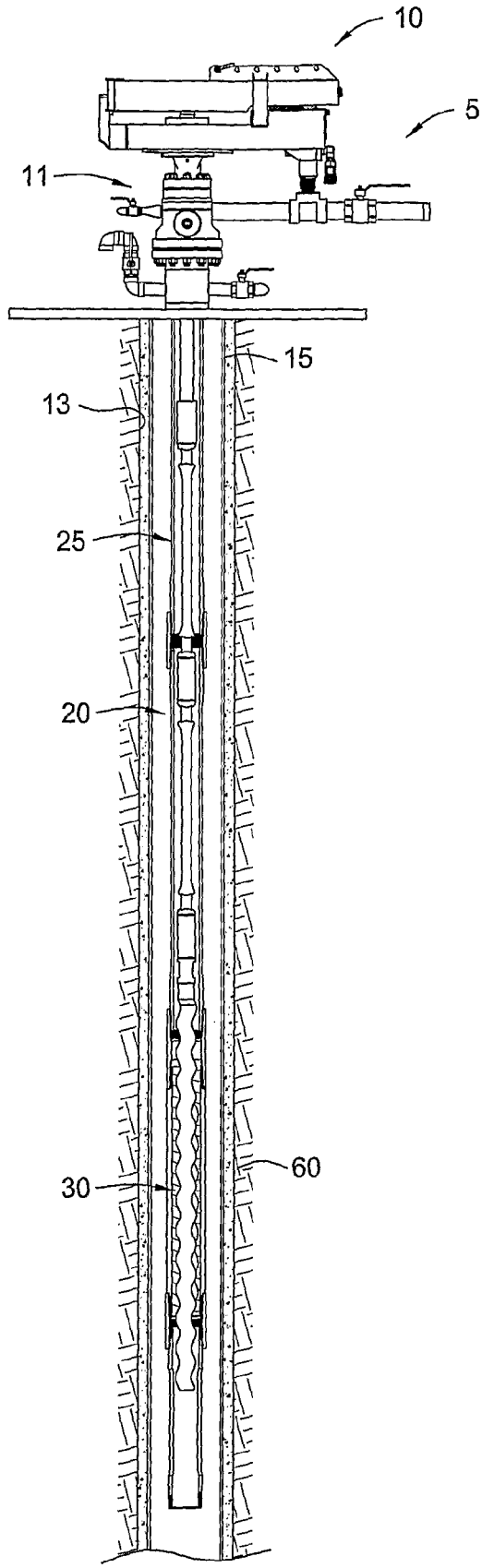
FIG. 1 is a sectional view of a downhole PCP having a surface drive mechanism.

FIG. 1 shows a PCP lift system, which includes a PCP 30 powered by one or more drive mechanisms 10. A valve system 5 of the drive mechanism 10 regulates fluid flow through the PCP 30. The drive mechanism 10 generally includes a motor, such as a hydraulic motor, for providing torque and rotation to a drive string or rod string 25 (also termed "sucker rod") disposed within the drive mechanism 10. The drive string 25 operatively connects the PCP 30 to the motor of the drive mechanism 10.

A wellbore 13 extends into an earth formation 60 below the drive mechanism 10. Casing 15 is preferably set within the wellbore 13 using cement or some other physically alterable bonding material. (In the alternative, the wellbore 13 may be only partially cased or may be an open hole wellbore.) Preferably, the casing 15 extends from a wellhead 11, which provides a sealed environment for the PCP 30. The wellhead 11 comprises high and low pressure rams to manage the pressure of the fluid within the wellbore 13 and to keep the fluid from escaping into the atmosphere from the interface between the wellhead 11 and the remainder of the wellbore components below. Generally, one or more packing elements (not shown) disposed within the wellhead 11 may be utilized to prevent fluid from escaping from the wellhead 11.

A tubular body 20 having a longitudinal bore therethrough, which may include production tubing, is disposed within and coaxial with the casing 15. The tubular body 20 extends from the surface of the wellbore 13 and provides a path for fluid flow therethrough.

The PCP 30, which exists within the tubular body 20, generally includes the drive string or sucker rod 25, which is rotatable relative to the tubular body 20 (and relative to the drive mechanism 10) by operation of the drive mechanism 10. The drive string 25 may include one or more sucker rods connected to one another by threaded connections and/or one or more polished rods connected to one another by threaded connections.

Figure 2:
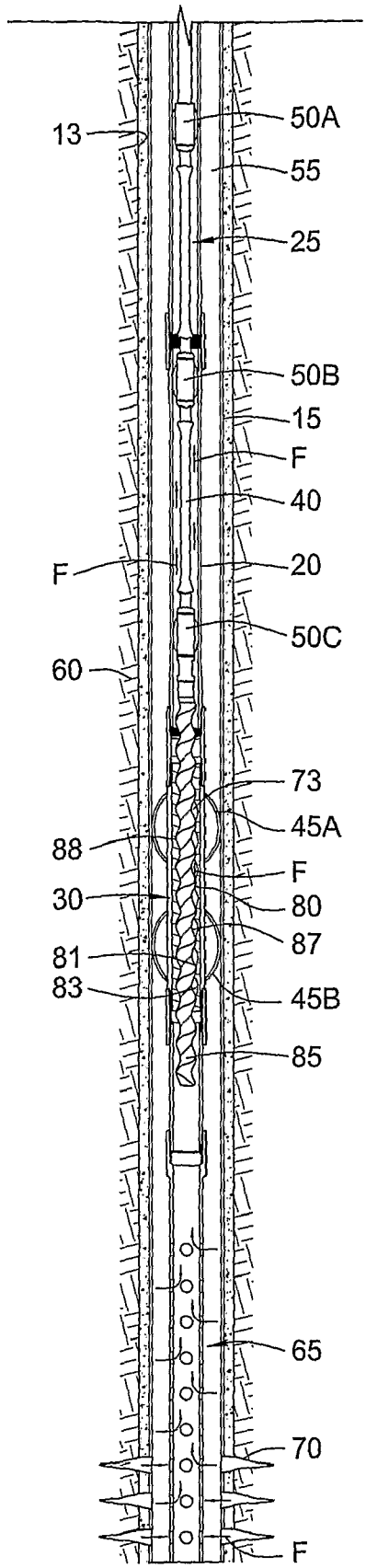
FIG. 2 is a sectional view of a downhole PCP rotating in a first direction to pump production fluid from downhole up to the surface of the wellbore.
Figure 3:
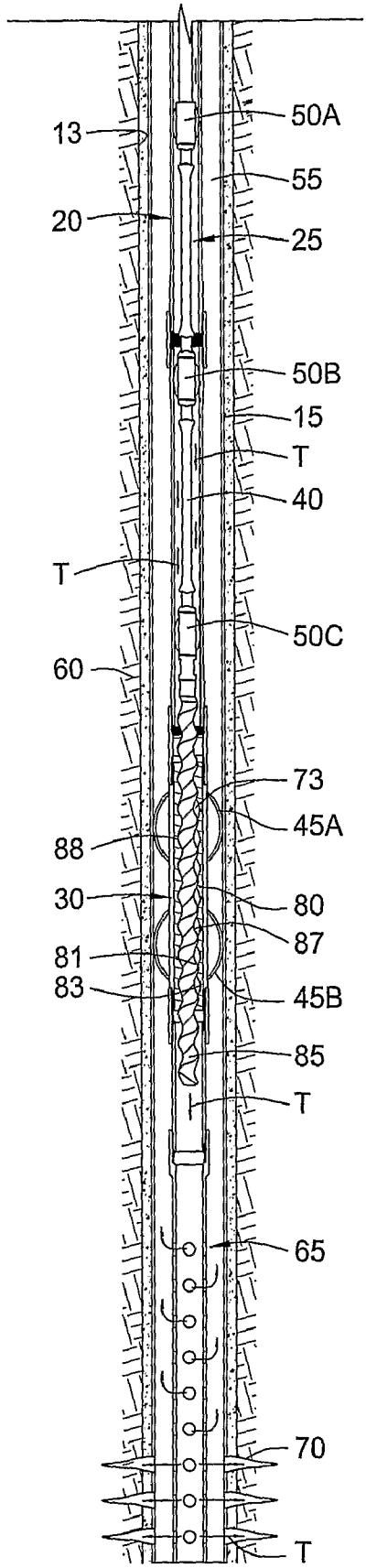
FIG. 3 is a sectional view of the downhole PCP of FIG. 2 rotating in a second direction, which is opposite of the first direction, to pump treatment fluid from the surface to downhole within the wellbore.

FIGS. 2 and 3 illustrate the section of the wellbore 13 having the PCP 30 therein. One or more pony rods 40 may exist within the sucker rod string 25 at its lower end, and the one or more pony rods 40 may be connected to a rotor 85. One or more rod centralizers 50A, 50B, 50C may optionally be strategically placed along an outer diameter of the rod string 25 and spaced from one another along the length of the rod string 25 to centralize the position of the rod string 25 within the tubular body 20. Additionally, one or more tubing centralizers 45A, 45B may optionally be placed on an outer diameter of the tubular body 20 to position the tubular body 20 within the casing 15. The tubing centralizers 45A, 45B are spaced along the length of the tubular body 20 and are preferably disposed proximate to a lower end of the tubular body 20.

The tubular body 20 may include a sand screen 65 at or near its lower end. The sand screen 65 possesses one or more perforations therethrough and is capable of filtering solid particles from fluid flowing into the tubular body 20 from outside the tubular body 20 and fluid flowing from within the tubular body 20 to outside the tubular body 20. One or more perforations 70 also extend from the inner diameter of the casing 15 into the formation 60 so that fluid may flow into and out from an area of interest within the formation 60. The area of interest may be a reservoir containing hydrocarbon fluids.

Within the tubular body 20, the PCP 30 includes the rotor 85 disposed concentrically within a stator 80. The rotor 85 is operatively attached to the drive mechanism 10, and the stator 80 is operatively attached to the inner diameter of the tubular body 20. The rotor 85 is rotatable relative to the stationary stator 80 by the drive string 25 to pump fluid in a direction within the tubular body 20. The rotor 85 is helically-shaped, while the stator 80 is elastomer-lined and also helically-shaped. The rotor 85 has a plurality of undulations 87 therein, and the stator 80 has a plurality of undulations 83 therein. Similarly, inner diameter extensions 88 exist between the undulations 87 of the rotor 85 and inner diameter extensions 81 exist between the undulations 83 of the stator 80. The stator undulations 83 mate with the rotor extensions 88 at various points in time during the rotation of the rotor 85.

At all rotational positions of the rotor 85 within the stator 80, an area 73 exists between the rotor 85 and the stator 80 through which fluid may be conveyed. As the rotor 85 rotates eccentrically within the stator 80, the area 73 includes a series of sealed cavities which form and progress from the fluid inlet end to the fluid discharge end of the PCP 30. Thus as the rotor 85 rotates within the stator 80, the fluid spirals down through the area 73 into the lower end of the tubular body 20 or spirals up through the area 73 into an upper portion of the tubular body 20. The result is a non-pulsating positive displacement of fluid with a discharge rate from the PCP 30 generally proportional to the size of the area 73, rotational speed of the rotor 85, and differential pressure across the PCP 30. The direction of rotation (clockwise or counterclockwise) of the rotor 85 determines the direction in which the fluid flows (up or down through the area 73). Exemplary PCP's which may be utilized as the PCP 30 of the present invention include those disclosed and shown in U.S. Pat. No. 1,892,217 filed on Apr. 27, 1931 by Moineau or commonly-owned U.S. Patent Application Serial Number 2003/0146001 filed on Aug. 7, 2003 by Hosie et al., each of which is herein incorporated by reference in its entirety. The operation of the PCP 30 in pumping production fluid F to the surface is disclosed in the above-incorporated-by-reference patent and patent application.

In operation, the tubular body 20 and the PCP 30 are inserted into the casing 15 within the wellbore 13. The lower end of the sucker rod string 25 is operatively connected to an upper end of the rotor 85 to provide communication between the PCP 30 and the drive mechanism 10. The drive mechanism 10 is activated to rotate the drive string 25 in a first direction, thereby rotating the rotor 85 in the first direction. As shown in FIG. 2, production fluid F flows into the wellbore 13 from the area of interest in the formation 60 through the perforations 70. The fluid F then flows into the sand screen 65 via the sand screen perforations, and the filtered fluid F is pumped up through the inner diameter of the tubular body 20 by rotation of the rotor 85 in the first direction.

The rotation of the rotor 85 is effected by the drive mechanism 10 (see FIG. 1) providing rotational force to the rod string 25. The drive mechanism 10 should be configured to reverse the direction of the rod string 25 rotation, preferably by providing a reversible motor within the drive mechanism 10. A reversible motor is capable of rotating the rod string 25 in two directions, both clockwise and counterclockwise.

To impart rotational force to the rod string 25, the drive mechanism 10 may include a reversible hydraulic motor, reversible electric motor, reversible V-8 engine, reversible truck engine, or any other type of reversible mechanism capable of rotating the rod string 25. Motors which are not reversible motors but still capable of rotating the rotor 85 in two directions are also contemplated. Exemplary drive mechanisms in which a reversible motor may be provided for embodiments of the present invention include but are not limited to the drive mechanisms shown and described in commonly-owned U.S. Pat. No. 6,557,643 filed on Nov. 10, 2000 by Hall et al. or commonly-owned U.S. Pat. No. 6,358,027 filed on Jun. 23, 2000 by Lane, each of which patents is herein incorporated by reference in its entirety. Multiple drive mechanisms may also be used to power the PCP 30, and each of the drive mechanisms may include reversible motors. In another embodiment, the drive mechanism may be located downhole. For example, the drive mechanism may comprise a subsurface motor positioned downhole and adapted to drive the progressive cavity pump. The subsurface motor may be operated by electricity, hydraulic fluid, or any manner known to a person of ordinary skill in the art.

After the production fluid F flows into the sand screen 65, the fluid F travels up through the inner diameter of the tubular body 20 until it reaches a lower end of the PCP 30. Rotating the rod string 25 in the first direction using the drive mechanism 10 then forces fluid F up through the areas 73 as the rotor 85 moves upward through the stator 80 by rotation relative to the stator 80, the fluid F being positively displaced by the PCP 30 during the rotation. The fluid F then is pumped out of the upper end of the PCP 30 and subsequently flows up through the inner diameter of the tubular body 20 to the surface of the wellbore 13. The PCP 30 adds energy to the fluid F as it travels from the lower end to the upper end of the PCP 30, forcing the fluid F to the surface of the wellbore 13.

At some point during production of the fluid F, it may be desired or necessary to treat the area of interest in the formation 60 (e.g., the reservoir or another portion of the formation 60) with one or more treatment fluids T, as shown in FIG. 3. To treat the formation 60, rotation of the rotor 85 within the stator 80 in the first direction is stopped to halt production of the production fluid F. Because the PCP 30 is reversible in direction of rotation of the rotor 85, the PCP 30 may then be utilized to pump treatment fluid T into the area of interest from the surface of the wellbore 13, eliminating the need for a separate truck-mounted pumping unit at the surface to pump the fluid T into the formation 60.

To pump fluid T down through the tubular body 20 using the PCP 30, one or more tanks (not shown) containing treatment fluid T are hooked up to the valve system 5 (see FIG. 1). Treatment fluid T is introduced into the inner diameter of the tubular body 20. The rotor 85 is rotated in a second direction, which is opposite from the first direction, by the rod string 25, which is rotated by the drive mechanism 10. The reversible motor reverses to rotate the drive string 25 in the second direction. The drive mechanism 10 may be configured to operate in the reverse direction by modifying the gear system of a mechanical motor at the surface, by reverse hydraulics when using a hydraulic motor, or by some other modification of a typical drive mechanism motor utilized with a PCP 30, depending upon the type of drive mechanism 10 and motor utilized.

Rotation of the rotor 85 in the second direction pushes the treatment fluid T down through the areas 73 between the rotor 85 and the stator 80 in a spiraling fashion, all the time adding energy to the fluid T. The treatment fluid T then flows down through the lower end of the tubular body 20 and into the sand screen 65, out through the perforations of the sand screen 65, into the wellbore 13, then out through the perforations 70 in the formation 60. In this manner, the PCP 30 is operated in the reverse direction from the direction in which it was operated to obtain production fluid F from the formation 60, thereby forcing treatment fluid T down through the tubular body 20 into the formation 60. Ultimately, the same pump which pumps production fluid F up to the surface also pumps treatment fluid T into the formation 60 from the surface.

After a sufficient time for adequate treatment of the formation 60, the rotation of the rotor 85 in the second direction may be halted and production again commenced by rotating the rotor 85 in the first direction. Additional treatments may be performed between periods of production, as desired.

Figure 4:
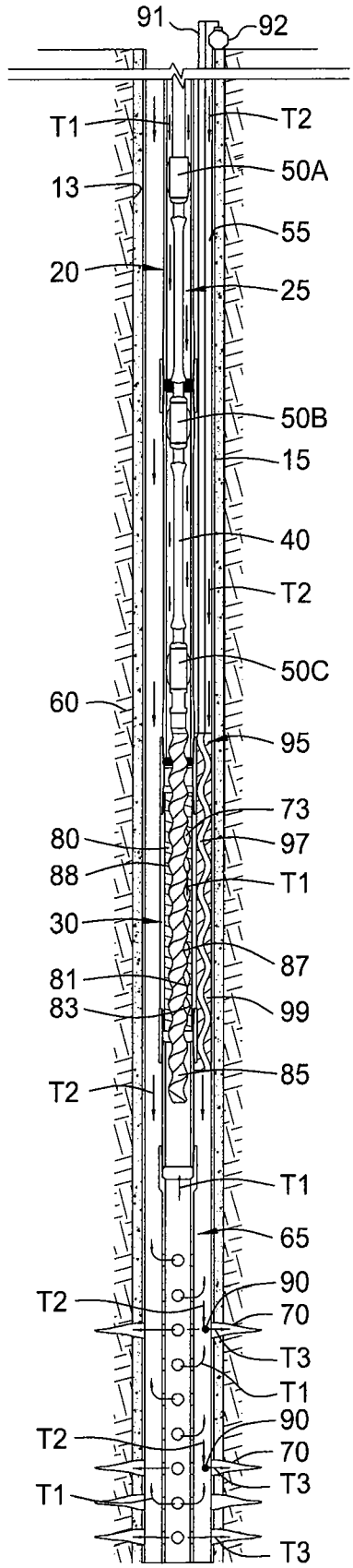
FIG. 4 is a sectional view of the downhole PCP of FIG. 3 rotating in the second direction. An additional downhole PCP is disposed within an annulus between production tubing and the wellbore wall. The additional PCP is also rotating in the second direction so that a first fluid which is pumped downward through the first PCP reacts downhole with a second fluid which is pumped downward through the additional PCP.

An alternate embodiment of the present invention is shown in FIG. 4. All of the components of the embodiment shown in FIGS. 1-3 except for the tubing centralizers 45A and 45B are included in the embodiment illustrated in FIG. 4, and the structure and operation of the components which are common to the figures are substantially the same. In addition, FIG. 4 shows an additional PCP 95 disposed in an annulus 55 between the inner diameter of the casing 15 and the outer diameter of the tubular body 20. The PCP 95 includes a rotor 97 located within a stator 99 and rotatable therein via a drive string 91 and a drive mechanism 92, the structure and operation of the rotor 97 and the stator 99 substantially similar to the structure and operation of the rotor 85 and stator 80 described above. The PCP 95 is capable of pumping fluid down through the annulus 55 from the surface of the wellbore 13 and may optionally also be capable of pumping fluid up to the surface. Fluid is pumped through the PCP 95 in the same way that fluid is pumped through the PCP 30, as described above.

In the operation of the embodiment of FIG. 4, production fluid F is pumped up to the surface using the PCP 30 as shown and described in relation to FIG. 2. When it is desired to treat the formation 60, rotation of the rotor 85 in the first direction is halted, and the rotor 85 is rotated in the second direction, as also described above. In the embodiment shown in FIG. 4, however, a first fluid T1 is introduced into the tubular body 20 from the surface. The first fluid T1 is acted upon by the PCP 30 to pump the first fluid T1 down through the tubular body 20, adding energy to the first fluid T1 as it travels downhole.

Before, at the same time, or at some point thereafter, a second fluid T2 is flowed into the annulus 55 from the surface of the wellbore 13. The PCP 95 disposed in the annulus 55 pumps the second fluid T2 down through the annulus 55 in the same manner that the PCP 30 pumps the first fluid T1 down through the tubular body 20, the PCP 95 adding energy to the second fluid T2 as it travels downhole. The first fluid T1 and the second fluid T2 are preferably constituents of a chemical compound which are chemically reactable with one another to form a treatment fluid T3.

The first fluid T1 exits the tubular body 20 into the annulus 55 through perforations through the sand screen 65, and then the first fluid T1 meets the second fluid T2 at a point 90 within the wellbore 13. When the fluids T1 and T2 merge at point 90, a chemical reaction occurs downhole which forms treatment fluid T3. Preferably, point 90 is at a face of the reservoir. Due to the action of the PCP 30 and the PCP 95, treatment fluid T3 is forced into the formation 60 through the perforations 70 to treat the formation 60.

The PCP 95 which adds energy to the second fluid T2 in the annulus 55 is not the only downhole pump usable with the present invention. In other embodiments, other types of downhole pumps which are known to those skilled in the art may be disposed within the annulus 55 to add energy to the second fluid T2.

Figure 5:
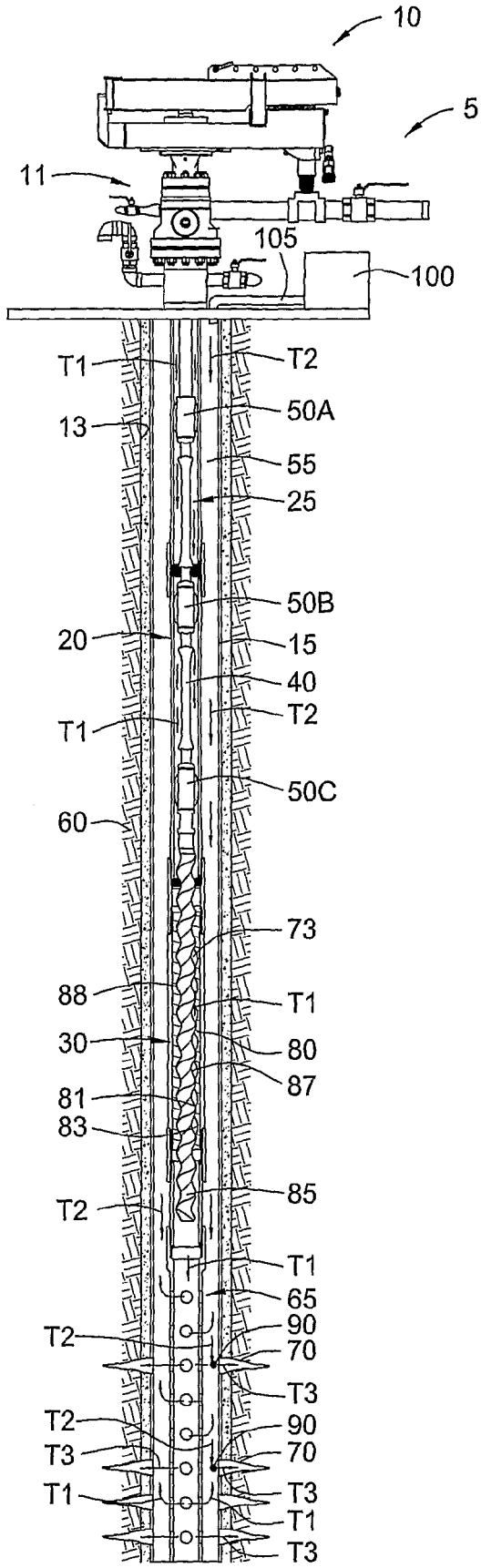
FIG. 5 is a sectional view of the downhole PCP of FIG. 3 rotating in a second direction. A surface pump is also shown which pumps a first fluid downhole into an annulus between production tubing and the wellbore wall to react downhole with a second fluid which is pumped downhole through the PCP.

A yet further alternate embodiment of the present invention is shown in FIG. 5. All of the components of the embodiment shown in FIGS. 1-3 are included in the embodiment shown in FIG. 5, and all of the components of FIG. 5 operate in substantially the same manner as the embodiments shown in FIGS. 1-3. The embodiment shown in FIG. 5 includes the additional component of a pump 100 disposed at the surface of the wellbore 13. The pump 100 is capable of pumping fluid down through the annulus 55. The pump 100 may include any pumping mechanism locatable at the surface which is capable of adding energy to the second fluid T2. Several pumps are known to those skilled in the art which are usable as the surface pump 100 of the present invention.

In the operation of the embodiment shown in FIG. 5, after a period of production using the PCP 30 to pump fluid in the first direction, the PCP 30 is operated to pump the first fluid T1 in the second direction downhole through the tubular body 20, and the surface pump 100 is operated to pump the second fluid T2 in the second direction downhole through the annulus 55. The fluids T1 and T2 meet at point 90, and a chemical reaction occurs to produce treatment fluid T3. Preferably, point 90 is at a face of the reservoir. Treatment fluid T3 is forced into the formation 60 due to the energy added to the fluids T1, T2 by the PCP 30 and surface pump 100. After treatment using the fluid T3 is continued on the formation 60 for a period of time, production may be resumed through the reverse operation of the PCP 30 (operating the PCP 30 in the opposite rotational direction).

The embodiments shown and described above in relation to FIGS. 4-5 become especially useful when treating the formation 60 with time-sensitive chemicals (chemicals which lose their effectiveness over time), as the time during which the treatment fluid T3 exists prior to its injection into the formation 60 is greatly reduced by reacting two components T1, T2 of the fluid T3 downhole proximate to the point of insertion of the treatment fluid T3 into the reservoir (or some other area of interest in the formation 60). A particular use for the embodiment of FIGS. 4-5 involves cross-linking polymers for a chemical reaction downhole for water conformance operations involving altering the hydrocarbon/water ratio of production fluid flowing from the reservoir.

Examples of treatment fluids T, T3 which may be used in embodiments of the present invention include (but are not limited to) scale or corrosion treatment fluids, proppants, elastomers used for scale squeezes, polymers, cross-linked polymers, inhibitors, functional additives, or any other treatment fluid known by those skilled in the art for treating the formation. Fluid treatment operations which may be performed using the reversible PCP 30 include (but are not limited to) well fracturing to improve draining ability of the reservoir, acidizing to clean the perforations of fine particles which routinely migrate from within the formation, scale treatments performed to control the presence of scale, corrosion treatments performed to control the presence of corrosion, scale squeezes, paraffin treatments performed to control paraffin buildup, water conformance treatments involving pumping a water-soluble polymer into the reservoir to change the hydrocarbon/water ratio and the viscosity of the production fluid flowing from the reservoir, or any other treatment operation performed on the formation by treatment fluid which is known to those skilled in the art. The reversible PCP used in embodiments of FIGS. 4-5 is particularly useful when pumping polymers such as water-control polymers which are shear-sensitive (tend to shear easily).

Any of the above embodiments shown in FIGS. 1-5 may optionally include a sensing system, which may either be located at the well site or remote from the well site. The sensing system includes one or more sensors disposed within the wellbore capable of measuring pressure of the fluid flowing through a portion of the wellbore (preferably in real time).

The sensors may be electric or optical. One or more cables (e.g., optical waveguides or electrical cables) connect the sensors to a surface monitoring and control unit located at the surface of the wellbore and communicate the pressure within the wellbore to the surface monitoring and control unit. The surface monitoring and control unit is then capable of altering the operation of the PCP 30, PCP 95, and/or surface pump 100 to attain the fluid pressure desired within the wellbore.

Although the above description involve d a cased wellbore 13, embodiments of the present invention are equally applicable to an open hole wellbore. Furthermore, even though the above description focuses on a generally vertical wellbore and uses terms such as "upward," "downward," "up," and "down," the positions are merely relative to one another and the wellbore may be horizontal, lateral, deviated, directionally drilled, or of any other configuration.

Embodiments of the present invention permit pumping over extended periods of time without using surface pumping equipment mounted on trucks, reducing the cost of the well by eliminating the need to rent expensive surface pumping equipment and reducing the cost of safety hazards associated with pumping the chemicals using the surface pumping equipment. The cost of the well is also reduced because the PCP does not require removal from the wellbore to allow the use of the surface pumping unit and then re-insertion into the wellbore after treatment of the formation, allowing more time for the treatment operation. Eliminating the time required to remove and re-insert the PCP into the wellbore also permits more hydrocarbon production time due to decreased well down-time.

The cost savings using embodiments of the present invention are particularly applicable when the producing well is offshore. Transporting equipment to offshore well sites is especially costly; therefore, eliminating the transportation cost of external pumping equipment for pumping treatment fluid into the well decreases the cost of the well, increasing profitability of the well.

Because expensive truck-mounted units are eliminated by use of embodiments of the present invention, a number of well treatments which are most effective when using low flow rates over long periods of time may be performed without a decrease in the profits of the well. Therefore, these more effective low flow rate treatments may be performed rather than the less effective high flow rate, short period of time treatments, thereby increasing the period of time between fluid treatments (thus increasing well production time). Additionally, more frequent treatments may be accomplished if desired with use of embodiments of the present invention because the PCP already exists within the wellbore and additional pumping equipment does not need to be hooked up to the wellbore to perform each treatment.

In another embodiment, an apparatus for treating a location within an earth formation surrounding a wellbore comprises a reversible progressive cavity pump disposed within a tubular body, the progressive cavity pump comprising a rotor disposed within a stator, the rotor capable of rotating relative to the stator in a first direction and a second direction, wherein rotation of the rotor in the first direction is capable of pumping fluid in one direction within the tubular body and the rotation of the rotor in the second direction is capable of pumping fluid in an opposite direction within the tubular body.

In yet another embodiment, the apparatus further comprises a surface drive mechanism capable of rotating the rotor in the first and second directions. In yet another embodiment, wherein the one direction is from within the tubular body to a surface of the wellbore. In yet another embodiment, wherein the first direction is clockwise.

In yet another embodiment, the apparatus further comprises a pump disposed at a surface of the wellbore, the pump capable of pumping fluid into the wellbore.

In yet another embodiment, the apparatus further comprises an additional progressive cavity pump located outside the tubular body within an annulus between an outer diameter of the tubular body and a wall of the wellbore. In yet another embodiment, wherein the additional progressive cavity pump is capable of pumping fluid from a surface of the wellbore through the annulus.

In yet another embodiment, a method of pumping fluid in a wellbore within an earth formation comprises positioning a progressive cavity pump within the wellbore and operating the progressive cavity pump to pump a fluid downhole.

In one or more of the embodiments, the drive mechanism is positioned at the surface.

In one or more of the embodiments, the drive mechanism is positioned subsurface.

In one embodiment, the method further comprises coupling the progressive cavity pump to a drive mechanism.

In one embodiment, the method further comprises operating the progressive cavity pump to pump a second fluid in a direction opposite the first fluid.

While the foregoing is directed to embodiments of the present invention, other and further embodiments of the invention may be devised without departing from the basic scope thereof, and the scope thereof is determined by the claims that follow.

I claim:

1. A method of pumping fluid in a wellbore within an earth formation, comprising:

providing a first progressive cavity pump within a tubular body, the first progressive cavity pump disposed downhole through the tubular body within the wellbore;

providing a second pump in an annulus between an outer diameter of the tubular body and a wall of the wellbore; and operating the first progressive cavity pump to pump a first fluid from a surface of the wellbore downhole into the wellbore.

2. The method of claim 1, further comprising operating the first progressive cavity pump to pump a second fluid from downhole through the tubular body to the surface of the wellbore.

3. The method of claim 2, wherein:

the first progressive cavity pump comprises a rotor rotatable within a stator; and operating the first progressive cavity pump to pump the first fluid downhole comprises rotating the rotor in a first direction relative to the stator.

4. The method of claim 3, wherein operating the first progressive cavity pump to pump the second fluid to the surface comprises rotating the rotor in a second direction relative to the stator, the second direction opposite from the first direction.

5. The method of claim 2, further comprising operating the second pump to pump a third fluid downhole through the annulus within the wellbore.

6. The method of claim 5, further comprising combining the first and third fluids down hole to produce a fourth fluid.

7. The method of claim 6, further comprising flowing the fourth fluid into a location within the formation.

8. The method of claim 7, wherein combining the first and third fluids occurs proximate to the location.

9. The method of claim 8, wherein the location is a reservoir.

10. The method of claim 6, wherein combining the first and third fluids occurs after the first fluid exits the first progressive cavity pump and after the third fluid exits the second pump.

11. The method of claim 6, wherein the first fluid comprises one or more cross-linked polymers.

12. The method of claim 6, wherein at least one of the first, third, and fourth fluids include at least one of a polymer, a cross-linked polymer, a scale or corrosion treatment fluid, a proppant, an elastomer, an inhibitor, and a functional additive.

13. The method of claim 1, wherein the second pump is a progressive cavity pump.

14. The method of claim 1, further comprising operating the second pump to pump a second fluid downhole into an annulus between an outer diameter of the tubular body and a wellbore wall.

15. The method of claim 14, further comprising combining the first and second fluids downhole to produce a third fluid.

16. The method of claim 15, further comprising flowing the third fluid into a location within the formation.

17. The method of claim 16, wherein combining the first and second fluids occurs proximate to the location.

18. The method of claim 17, wherein the location is a reservoir.

19. The method of claim 14, wherein combining the first and second fluids occurs after the first fluid exits the first progressive cavity pump.

20. The method of claim 14, wherein the first fluid comprises one or more cross-linked polymers.

21. The method of claim 15, wherein at least one of the first, second, and third fluids include at least one of a polymer, a cross-linked polymer, a scale or corrosion treatment fluid, a proppant, an elastomer, an inhibitor, and a functional additive.

22. The method of claim 1, further comprising injecting corrosion treatment fluid into a location within the formation using the first progressive cavity pump.

23. The method of claim 1, further comprising injecting scale treatment fluid into a location within the formation using the first progressive cavity pump.

24. The method of claim 1, further comprising injecting one or more proppants into a location within the formation using the first progressive cavity pump.

25. The method of claim 1, further comprising fluid-fracturing a location within the formation with the first fluid using the first progressive cavity pump.

26. The method of claim 1, further comprising performing one or more water conformance operations to inject one or more polymers into a reservoir within the formation using the first progressive cavity pump, thereby altering a component ratio of production fluid from the reservoir.

27. The method of claim 1, further comprising acidizing a location within the formation with the first fluid using the first progressive cavity pump.

28. The method of claim 1, further comprising controlling corrosion at a location within the formation with the first fluid using the first progressive cavity pump.

29. The method of claim 1, further comprising conducting a scale squeeze at a location within the formation with the first fluid using the first progressive cavity pump.

30. The method of claim 1, further comprising flowing the first fluid into a location within the formation.

31. The method of claim 1, further comprising actuating the first progressive cavity pump using a drive mechanism disposed at the surface.

32. The method of claim 1, further comprising actuating the first progressive cavity pump using a drive mechanism disposed downhole.

33. The method of claim 1, wherein the first fluid includes at least one of a polymer, a cross-linked polymer, a scale or corrosion treatment fluid, a proppant, an elastomer, an inhibitor, and a functional additive.

34. An assembly for treating a location within an earth formation surrounding a wellbore, comprising:

a reversible progressive cavity pump disposed within a tubular body, the progressive cavity pump comprising a rotor disposed within a stator, the rotor capable of rotating relative to the stator in a first direction and a second direction, wherein rotation of the rotor in the first direction is capable of pumping fluid in one direction within the tubular body and the rotation of the rotor in the second direction is capable of pumping fluid in an opposite direction within the tubular body; and a second pump disposed within an annulus between the tubular body and a wall of the wellbore, wherein each of the first and second pumps is arranged downhole to pump fluid from a surface of the wellbore to the earth formation.

35. The assembly of claim 34, further comprising a surface drive mechanism capable of rotating the rotor in the first and second directions.

36. The assembly of claim 34, wherein the one direction is from within the tubular body to the surface of the wellbore.

37. The assembly of claim 36, wherein the first direction is clockwise.

38. The assembly of claim 34, wherein the second pump is a progressive cavity pump.

39. The assembly of claim 38, wherein the second pump is capable of pumping fluid from the surface of the wellbore through the annulus.

40. A method of pumping fluid in a wellbore within an earth formation, comprising:

providing a first progressive cavity pump within a tubular body, the first progressive cavity pump disposed downhole through the tubular body within the wellbore;

providing a second pump in an annulus between an outer diameter of the tubular body and a wall of the wellbore;

operating the first progressive cavity pump to pump a first fluid downhole into the wellbore; and operating the first progressive cavity pump to pump a second fluid from downhole through the tubular body to a surface of the wellbore.

41. The method of claim 40, wherein:

the first progressive cavity pump comprises a rotor rotatable within a stator; and operating the first progressive cavity pump to pump the first fluid downhole comprises rotating the rotor in a first direction relative to the stator.

42. The method of claim 41, wherein operating the first progressive cavity pump to pump the second fluid to surface comprises rotating the rotor in a second direction relative to the stator, the second direction opposite from the first direction.

43. The method of claim 41, further comprising operating the second pump to pump a third fluid downhole through the annulus within the wellbore.

44. The method of claim 43, further comprising combining the first and third fluids downhole to produce a fourth fluid.

45. The method of claim 44, wherein combining the first and third fluids occurs after the first fluid exits the first progressive cavity pump and after the third fluid exits the second pump.

46. The method of claim 44, wherein at least one of the first, third, and fourth fluids include at least one of a polymer, a cross-linked polymer, a scale or corrosion treatment fluid, a proppant, an elastomer, an inhibitor, and a functional additive.

47. The method of claim 40, wherein the first fluid includes at least one of a polymer, a cross-linked polymer, a scale or corrosion treatment fluid, a proppant, an elastomer, an inhibitor, and a functional additive, and wherein the second fluid includes a production fluid.

48. A method of pumping fluid in a wellbore within an earth formation, comprising:

providing a first progressive cavity pump within a tubular body, the first progressive cavity pump disposed downhole through the tubular body within the wellbore;

providing a second pump in an annulus between an outer diameter of the tubular body and a wall of the wellbore;

operating the first progressive cavity pump to pump a first fluid downhole into the wellbore; and operating the second pump to pump a second fluid downhole into an annulus between an outer diameter of the tubular body and a wellbore wall.

49. The method of claim 48, further comprising combining the first and second fluids downhole to produce a third fluid.

50. The method of claim 49, further comprising flowing the third fluid into a location within the formation.

51. The method of claim 49, wherein combining the first and second fluids occurs after the first fluid exits the first progressive cavity pump.

52. The method of claim 49, wherein at least one of the first, second, and third fluids include at least one of a polymer, a cross-linked polymer, a scale or corrosion treatment fluid, a proppant, an elastomer, an inhibitor, and a functional additive.

* * * * *